United States Patent [19]

Lewakowski

[11] 4,151,873

[45] May 1, 1979

[54] REGENERATOR FOR GAS TURBINE ENGINE

[75] Inventor: John J. Lewakowski, Warren, Mich.

[73] Assignee: The United States of America as represented by the United States Department of Energy, Washington, D.C.

[21] Appl. No.: 872,204

[22] Filed: Jan. 25, 1978

[51] Int. Cl.[2] ..... F28D 19/00

[52] U.S. Cl. ..... 165/8; 74/443; 74/446

[58] Field of Search ..... 165/8, 10; 74/443, 446

[56] References Cited

U.S. PATENT DOCUMENTS

| | | | |
|---|---|---|---|
| 3,623,544 | 11/1971 | McLean | 165/8 |
| 3,960,209 | 6/1976 | Neubrand | 165/8 |

*Primary Examiner*—Albert W. Davis, Jr.

*Attorney, Agent, or Firm*—Dean E. Carlson; Frank H. Jackson

[57] ABSTRACT

A rotary disc-type counterflow regenerator for a gas turbine engine includes a disc-shaped ceramic core surrounded by a metal rim which carries a coaxial annular ring gear. Bonding of the metal rim to the ceramic core is accomplished by constructing the metal rim in three integral portions: a driving portion disposed adjacent the ceramic core which carries the ring gear, a bonding portion disposed further away from the ceramic core and which is bonded thereto by elastomeric pads, and a connecting portion connecting the bonding portion to the driving portion. The elastomeric pads are bonded to radially flexible mounts formed as part of the metal rim by circumferential slots in the transition portion and lateral slots extending from one end of the circumferential slots across the bonding portion of the rim.

2 Claims, 4 Drawing Figures

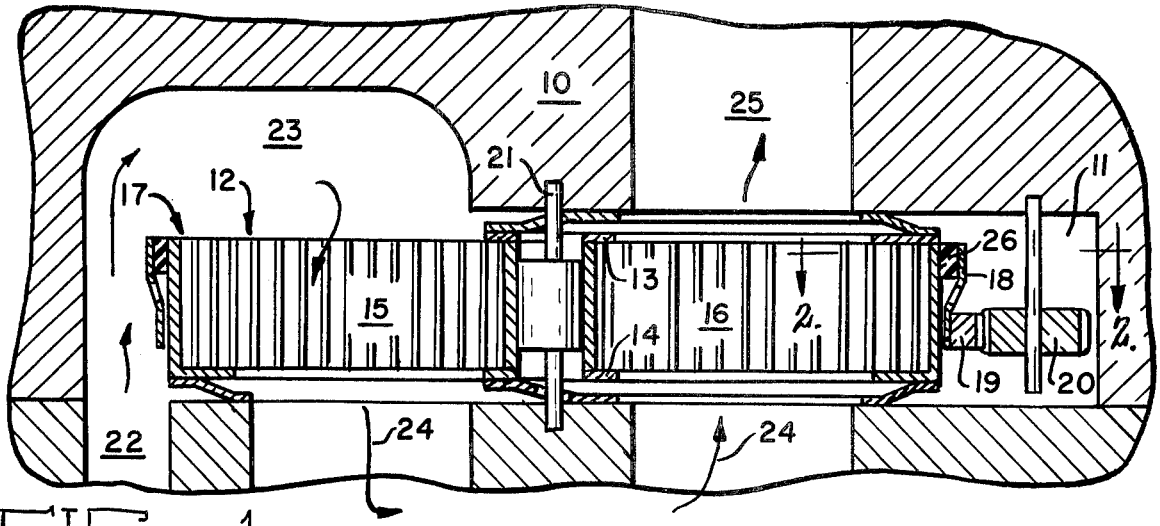
FIG 1
FIG 4
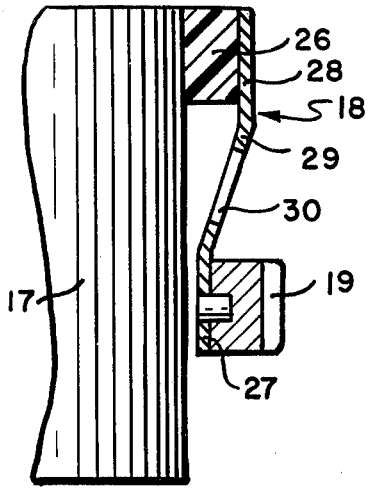
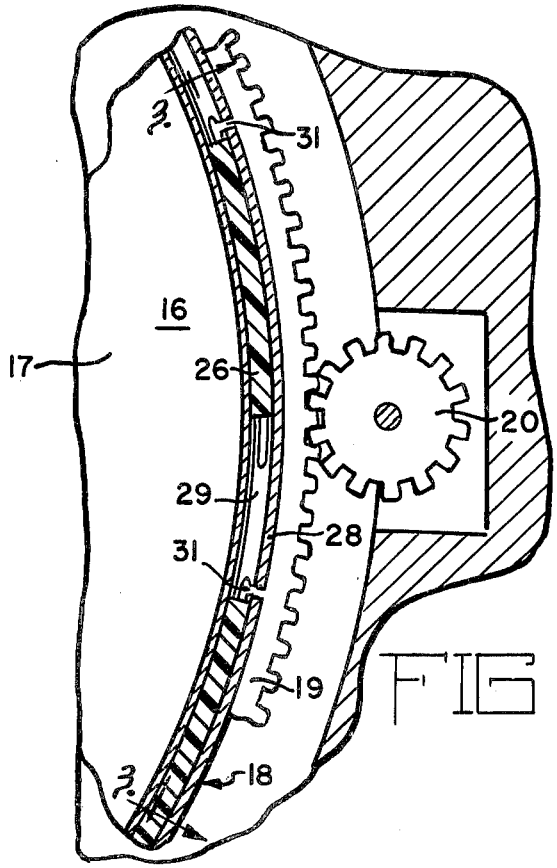
FIG 2
FIG 3
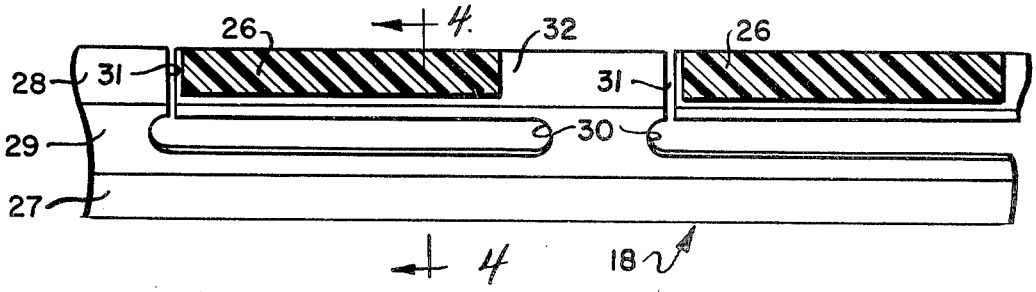

REGENERATOR FOR GAS TURBINE ENGINE

CONTRACTUAL ORIGIN OF THE INVENTION

The invention described herein was made in the course of, or under, a contract with the UNITED STATES DEPARTMENT OF ENERGY.

BACKGROUND OF THE INVENTION

This invention relates to improvements in the construction of a rotary disc-type regenerator for an automotive gas turbine engine. In more detail, the invention relates to improved means for attaching the relatively rigid metal ring gear to the ceramic regenerator core.

One common disc-type regenerator comprises a core or matrix having a multitude of parallel axially extending gas passages arranged about a central hub or axis of rotation and confined within a peripheral rim. The axially opposite ends of the gas passages are arranged in parallel planes perpendicular to the axis of rotation and comprising end faces of the matrix through which two oppositely directed streams of gas at different temperatures and pressures are conducted. For example, a sector shaped seal in sliding and sealing contact with each of the opposite end faces of the regenerator matrix partitions the latter into two sectors. Comparatively cool high-pressure inlet air is directed toward one end face of the matrix at one sector thereof, thence through that sector to be preheated by the hot regenerator matrix. The preheated air is then directed to a combustion chamber where fuel is added and burned, the hot combustion products being then directed through the turbine stages of the engine to drive the turbine rotors.

The comparatively hot low-pressure exhaust gases from the rotors are then directed through the other sector of the regenerator matrix in the direction axially opposite to the inlet air flow, whereby the latter regenerator matrix is heated. Rotation of the regenerator carries its heated sector continuously to the region of the first mentioned sector to receive the comparatively cool gas flow to preheat the inlet gas as aforesaid, and thereby to cool the regenerator.

Such a regenerator is commonly known as a counterflow regenerator and is feasible for use in automotive gas turbine engines. Rotation of the regenerator is accomplished with a power driven pinion which meshes with an annular ring gear carried by an annular rim on the regenerator. Attachment of the relatively rigid metal ring gear to the ceramic regenerator core has been a problem. Due to simplicity and commercial availability, use of an elastomeric pad bonded to both the ceramic core and the metal rim to attach the ring gear to the core appears to be a simple and attractive solution to the problem. Unfortunately, during the process of development of bonding procedures, various failures and subsequent tests indicated that the elastomeric material in addition to shrinkage during curing and aging is expanding and contracting depending on surrounding temperature. Since the bond quality between elastomer and ceramic, and elastomer and metal jacket has been significantly improved, it was not unusual to find that parts of the matrix at the O.D. were broken away from the rest of the core. Apparently the tensile force exerted on the matrix by shrinking elastomer exceeded the strength of the matrix.

SUMMARY OF THE INVENTION

According to the present invention the metal rim of a rotary disc-type counterflow regenerator is attached to the ceramic core by elastomeric pads which are bonded to the circumference of the ceramic core and to radially flexible mounts formed as part of the rim by circumferential and lateral slots therein.

BRIEF DESCRIPTION OF THE DRAWINGS

FIG. 1 is a fragmentary schematic mid-sectional view through the axis of rotation of the regenerator of a gas turbine engine embodying the present invention, FIG. 2 is a sectional detail taken along the line 2—2 in FIG. 1, FIG. 3 is a section taken along the line 3—3 in FIG. 2, and FIG. 4 is a section taken along the line 4—4 in FIG. 3.

DETAILED DESCRIPTION OF THE INVENTION

Referring to the drawings, a specific embodiment of the present invention is illustrated by way of example in a gas turbine engine for an automobile vehicle, the engine being shown schematically as a housing 10 having a regenerator chamber 11 containing a rotary counterflow disc-type regenerator 12. Upper and lower seals 13 and 14 between the upper and lower end faces respectively of the regenerator and supporting portions of the housing 10 partition the area of the regenerator into a high-pressure sector 15 and a low-pressure sector 16.

The regenerator 12 comprises a central core 17 and an annular rim 18 which carries a coaxial annular ring gear 19 meshed with a power-driven pinion 20. Regenerator 12 rotates on an axle 21.

Comparatively cool high-pressure inlet air or gas is supplied from a suitable compressor via an inlet duct 22 into a chamber 11 and a high-pressure inlet header 23 overlying the regenerator sector 15. The inlet gases in a typical automotive engine enter at approximately 60 psia and at approximately 400° F. The inlet gases pass from header 23 axially downwardly in FIG. 1 through a multitude of small parallel axially extending gas flow passages comprising the matrix of regenerator 12, whereby the inlet gases are preheated to approximately 1100° F. by the hot regenerator matrix. Thereafter the preheated inlet air follows a flow path indicated schematically by the numeral 24 through a combustion chamber where fuel is added and burned, and thence through the turbine rotor stages to drive the turbine rotors. The gases are exhausted from the turbine rotors at approximately 15 psia (atmospheric) and 1200° F. and are conducted upwardly in FIG. 1 through sector 16 to exhaust chamber 25. During the upward passages of the exhaust gases, the regenerator matrix is heated and the exhaust gases are cooled to approximately 500° F., whereupon the cool gases are exhausted to the atmosphere. The rotating regenerator continuously carries the heated portions from the region of sector 16 to the region of sector 15 to preheat the inlet gases and to cool the regenerator.

Annular rim 18 is bonded to regenerator 12 with elastomeric pads 26. To prevent damage to the regenerator matrix due to expansion and contraction of the elastomeric pads as the surrounding temperature changes, it has been found necessary to provide a special rim which will tolerate these forces. Annular rim 18 thus includes a driving portion 27 disposed adjacent the ceramic core but not bonded thereto which carries ring gear 19, a bonding portion 28 offset from the driving portion 27 disposed further away from the ceramic core than is the driving portion 27, and a transition portion 29 connecting the driving portion and the bonding portion and integral therewith. The transition portion has a plurality of circumferential cooling slots 30 therein equispaced around the rim. Lateral slots 31 extend from one end of the cooling slots 30 through the bonding portion of the rim to provide elongated radially flexible mounts 32 joined to the remainder of the rim at only one end and it is this mount to which elastomeric pads 26 are bonded. Radially flexible mounts 32 constitute circumferential cantilever springs which will deflect freely under radial forces. Transfer of tangential forces (driving torque) between the rim and the regenerator is not significantly affected by this arrangement, but radial forces, compressive or tensile, are significantly reduced.

Installation of the elastomer will next be described.

(1) The bonding surfaces are prepared by wire brushing the core edge if required and sand blasting the inner diameter of the rim.

(2) The surface is then primed by applying a primer thereto such as Dow Corning type 36-061. Primers of this type are described in U.S. Pat. No. 3,960,800 dated June 1, 1976. The surface is then allowed to air dry one hour.

(3) An elastomer as described in Example VII of said patent is then mixed. Particularly successful results have been attained by employing Sylgard® 187 —a black, tear-resistant, high-strength resin —as the base material in the elastomer. The mixture is next vacuum de-aired approximately 30 minutes under 711 mm Hg minimum vacuum, transferred to an injection-type cartridge and again de-aired.

(4) The core and rim is installed in an assembly fixture and the elastomer is injected in the annular space between core and rim to the proper dimensions.

(5) The assembly is finally cured in the fixture at 95° C. for 4 hours.

During the process of development of bonding procedures various failures and subsequent tests indicated that the elastomeric material in addition to shrinkage during curing and aging is expanding and contracting depending on surrounding temperature. In fact, it was found at times that, while the bonds between elastomer and ceramic and elastomer and rim did not fail, it was not unusual to find that parts of the regenerator matrix at the outer edge thereof were broken away from the rest of the core. Apparently the tensile forces on the matrix by shrinking elastomers exceeded the strength of the matrix.

The flexible mount of the present invention has solved this problem. This mount has been employed in several endurance tests and over a period of many hours no elastomer tears of matrix delaminations have occurred and gear runout remains unchanged.

The embodiments of the invention in which an exclusive property or privilege is claimed are defined as follows:

1. In a rotary disc-type counterflow regenerator for a gas turbine engine comprising a disc-shaped ceramic core provided with a circumferential metal rim carrying a coaxial annular ring gear wherein the metal rim is bonded to the ceramic core by elastomeric pads, the improvement wherein the metal rim is slotted to provide radially flexible mounts for the elastomeric pads.

2. A rotary disc-type counterflow regenerator for a gas turbine engine comprising a disc-shaped ceramic core provided with a circumferential metal rim including a driving portion disposed adjacent the ceramic core carrying a coaxial annular ring gear, a bonding portion disposed further away from the ceramic core than is the driving portion and a transition portion connecting the driving portion and the bonding portion, said transition portion having circumferential cooling slots equispaced therearound, and lateral slots extending from one end of each of the circumferential cooling slots through the bonding portion of the rim to create elongated and radially flexible mounts joined to the remainder of the rim at only one end and elastomeric pads bonded to the ceramic core and to the radially flexible mounts.

* * * * *